US008187034B2

(12) United States Patent
Fedder et al.

(10) Patent No.: US 8,187,034 B2
(45) Date of Patent: May 29, 2012

(54) ELECTRICAL CONNECTOR SYSTEM

(75) Inventors: James Lee Fedder, Etters, PA (US); John Edward Knaub, Etters, PA (US); Lynn Robert Sipe, Mifflintown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 15 days.

(21) Appl. No.: 12/713,710

(22) Filed: Feb. 26, 2010

(65) Prior Publication Data

US 2010/0151726 A1 Jun. 17, 2010

Related U.S. Application Data

(63) Continuation-in-part of application No. 12/474,568, filed on May 29, 2009, now Pat. No. 7,976,318.

(60) Provisional application No. 61/200,955, filed on Dec. 5, 2008, provisional application No. 61/205,194, filed on Jan. 16, 2009.

(51) Int. Cl.
*H01R 13/648* (2006.01)

(52) U.S. Cl. ..... 439/607.01; 439/941

(58) Field of Classification Search ..... 439/607.01, 439/607.03, 607.05, 607.08, 607.09, 607.11, 439/941

See application file for complete search history.

(56) References Cited

U.S. PATENT DOCUMENTS

| | | | | |
|---|---|---|---|---|
| 5,882,227 | A | 3/1999 | Neidich | |
| 6,506,076 | B2 | 1/2003 | Cohen et al. | |
| 6,676,450 | B2 | 1/2004 | Schroll | |
| 6,709,294 | B1 | 3/2004 | Cohen et al. | |
| 6,808,414 | B2 * | 10/2004 | Spiegel et al. | 439/579 |
| 6,843,687 | B2 * | 1/2005 | McGowan et al. | 439/607.06 |
| 6,899,566 | B2 | 5/2005 | Kline et al. | |
| 6,932,626 | B2 | 8/2005 | Costello et al. | |
| 7,163,421 | B1 | 1/2007 | Cohen et al. | |
| 7,207,807 | B2 | 4/2007 | Fogg | |
| 7,217,889 | B1 | 5/2007 | Parameswaran et al. | |
| 7,335,063 | B2 | 2/2008 | Cohen et al. | |
| 7,371,117 | B2 | 5/2008 | Gailus | |
| 7,381,092 | B2 * | 6/2008 | Nakada | 439/607.1 |
| 7,384,311 | B2 * | 6/2008 | Sharf et al. | 439/607.05 |
| 7,780,474 | B2 * | 8/2010 | Ito | 439/607.05 |
| 2003/0022555 | A1 | 1/2003 | Vicich et al. | |

* cited by examiner

*Primary Examiner* — Thanh Tam Le

(57) ABSTRACT

A wafer assembly of an electrical connector system may include a metal center ground plane and a plurality of plastic ribs overmolded on the metal center ground plane. The plastic ribs may be positioned in a configuration that forms a plurality of electrical contact channels on the metal center ground plane. An array of electrical contacts may be positioned substantially within the plurality of electrical contact channels. In some implementations, the electrical connector system may also include a wafer housing and a header module that include guidance components that align the header module with the wafer housing when the wafer housing mates with the header module. The electrical connector system may also include a power contact that passes through aligned openings in the wafer housing and the header module to provide a power transmission path between the first substrate and the second substrate.

15 Claims, 16 Drawing Sheets

ELECTRICAL CONNECTOR SYSTEM

PRIORITY CLAIM

This application is a continuation-in-part of U.S. patent application Ser. No. 12/474,568, filed May 29, 2009 now U.S. Pat No. 7,976,318, which claims priority to U.S. Provisional Pat. App. No. 61/200,955, filed Dec. 5, 2008, and claims priority to U.S. Provisional Pat. App. No. 61/205,194, filed Jan. 16, 2009, the entirety of each of these applications is hereby incorporated by reference.

RELATED APPLICATIONS

The present application is related to U.S. patent application Ser. No. 12/474,568, U.S. patent application Ser. No. 12/474,587, U.S. patent application Ser. No. 12/474,605, U.S. patent application Ser. No. 12/474,545, U.S. patent application Ser. No. 12/474,505, U.S. patent application Ser. No. 12/474,772, U.S. patent application Ser. No. 12/474,626, and U.S. patent application Ser. No. 12/474,674, each titled "Electrical Connector System," each filed May 29, 2009, and each claiming priority to U.S. Provisional Pat. App. No. 61/200,955, filed Dec. 5, 2008 and U.S. Provisional Pat. App. No. 61/205,194, filed Jan. 16, 2009, the entirety of each of which is hereby incorporated by reference.

The present application is also related to U.S. patent application Ser. No. 12/641,904, titled "Electrical Connector System," filed Dec. 18, 2009, which is a continuation-in-part of U.S. patent application Ser. No. 12/474,605, the entirety of each of which is hereby incorporated by reference.

The present application is also related to U.S. patent application Ser. No. 12/648,700, titled "Electrical Connector System," filed Dec. 29, 2009, which is a continuation-in-part of U.S. patent application Ser. No. 12/474,674, the entirety of each of which is hereby incorporated by reference.

The present application is also related to U.S. patent application Ser. No. 12/713,741,titled "Electrical Connector System," filed Feb. 26, 2010, which is a continuation-in-part of U.S. patent application Ser. No. 12/474,568, the entirety of each of which is hereby incorporated by reference.

BACKGROUND

Backplane connector systems are typically used to connect a first substrate, such as a printed circuit board, in a parallel or perpendicular relationship with a second substrate, such as another printed circuit board. As the size of electronic components is reduced and electronic components generally become more complex, it is often desirable to fit more components in less space on a circuit board or other substrate. Consequently, it has become desirable to reduce the spacing between electrical terminals within backplane connector systems and to increase the number of electrical terminals housed within backplane connector systems. Accordingly, it is desirable to develop backplane connector systems capable of operating at increased speeds, while also increasing the number of electrical terminals housed within the backplane connector system.

SUMMARY

A wafer assembly of an electrical connector system may include a metal center ground plane and a plurality of plastic ribs overmolded on the metal center ground plane. The plastic ribs may be positioned in a configuration that forms a plurality of electrical contact channels on the metal center ground plane. An array of electrical contacts may be positioned substantially within the plurality of electrical contact channels.

In another implementation, a wafer assembly of an electrical connector system may include a metal center ground plane and a plurality of first plastic ribs overmolded on a first side face of the metal center ground plane. The plastic ribs may be positioned in a configuration that forms a plurality of first electrical contact channels on the first side face of the metal center ground plane. A first array of electrical contacts may be positioned substantially within the plurality of first electrical contact channels. The wafer assembly may include a plurality of second overmolded ribs on a second side face of the metal center ground plane in a configuration that forms a plurality of second electrical contact channels on the second side face of the metal center ground plane. A second array of electrical contacts may be positioned substantially within the plurality of second electrical contact channels.

In yet another implementation, an electrical connector system includes a plurality of wafer assemblies. Each of the wafer assemblies includes a housing component, a plurality of electrical contact channels formed on a side face of the housing component, and an array of electrical contacts positioned substantially within the plurality of electrical contact channels. The array of electrical contacts comprises a plurality of first electrical connectors configured to connect with a first substrate and a plurality of second electrical connectors configured to connect with a second substrate. The electrical connector system may also include a wafer housing that positions the plurality of wafer assemblies adjacent to one another in the electrical connector system. The wafer housing comprises a first guidance component. A header module of the electrical connector system mates with the wafer housing. The header module comprises a second guidance component dimensioned to engage with the first guidance component to align the header module with the wafer housing when the wafer housing mates with the header module. The electrical connector system may also include a power contact that passes through aligned openings in the wafer housing and the header module to provide a power transmission path between the first substrate and the second substrate.

In still another implementation, an electrical connector system includes a plurality of wafer assemblies. Each of the wafer assemblies includes metal center ground plane and plurality of plastic ribs overmolded on the metal center ground plane. The plastic ribs may be positioned in a configuration that forms a plurality of first electrical contact channels on a first side face of the metal center ground plane and a plurality of second electrical contact channels on a second side face of the metal center ground plane. A first array of electrical contacts may be positioned substantially within the plurality of first electrical contact channels. A second array of electrical contacts positioned substantially within the plurality of second electrical contact channels. The first and second arrays of electrical contacts are configured to connect with a first substrate and a second substrate and provide a plurality of signal transmission paths between the first substrate and the second substrate. The electrical connector system may also include a wafer housing that positions the plurality of wafer assemblies adjacent to one another in the electrical connector system. The wafer housing includes a first guidance component. The electrical connector system includes a header module that mates with the wafer housing. The header module includes a second guidance component dimensioned to engage with the first guidance component to align the header module with the wafer housing when the wafer housing mates with the header module. The electrical connector system also includes a power contact that passes through aligned openings in the wafer housing and the header module to provide a power transmission path between the first substrate and the second substrate.

Other systems, methods, features and advantages will be, or will become, apparent to one with skill in the art upon examination of the following figures and detailed description.

DETAILED DESCRIPTION

Figure 1:
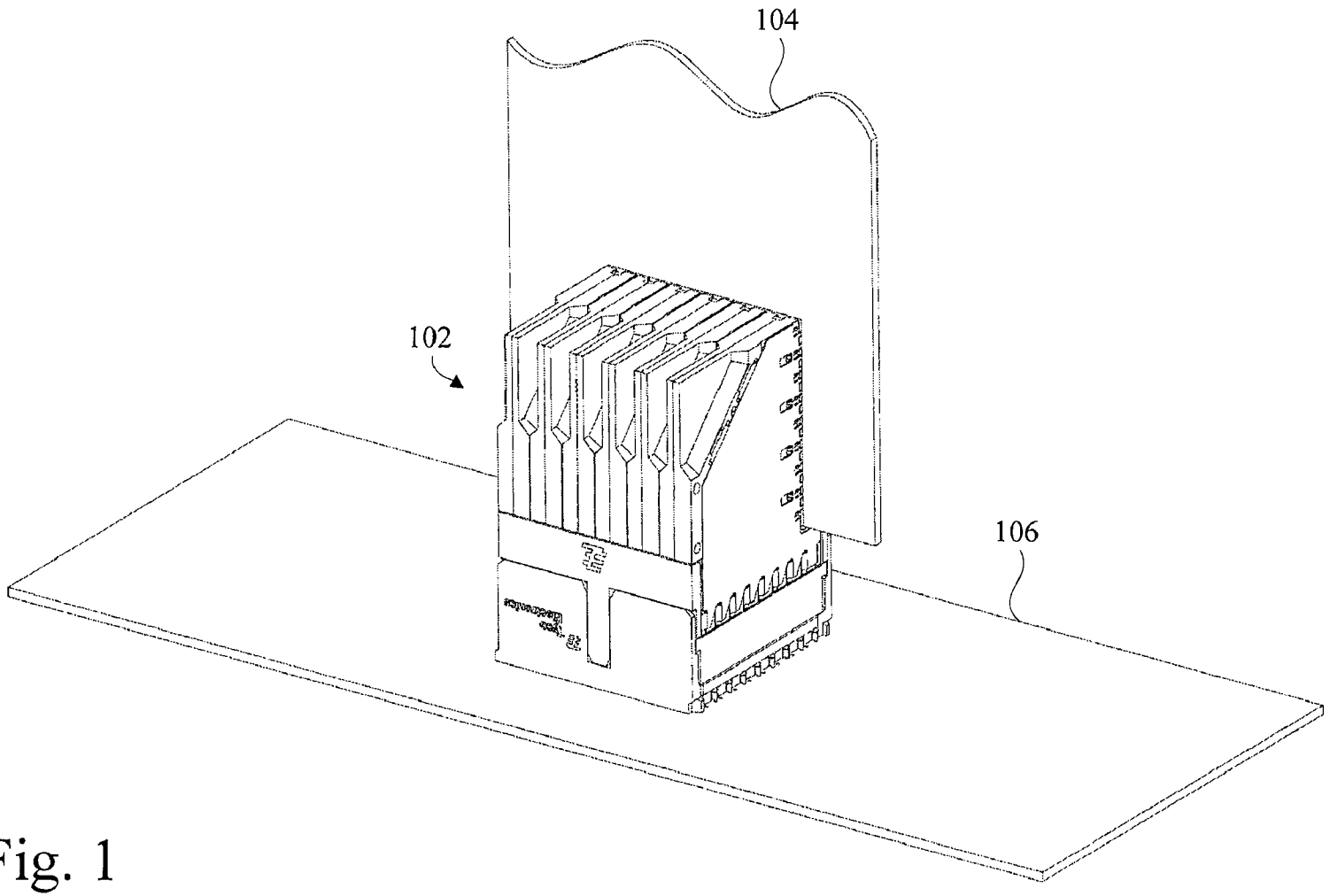
FIG. 1 is a diagram of a backplane connector system connecting a first substrate to a second substrate.

The present disclosure is directed to backplane connector systems that connect with one or more substrates. The backplane connector systems may be capable of operating at high speeds (e.g., up to at least about 25 Gbps), while in some implementations also providing high pin densities (e.g., at least about 50 pairs of electrical connectors per inch). In one implementation, as shown in FIG. 1, a backplane connector system 102 may be used to connect a first substrate 104, such as a printed circuit board, in a parallel or perpendicular relationship with a second substrate 106, such as another printed circuit board. Implementations of the disclosed connector systems may include ground shielding structures that substantially encapsulate electrical connector pairs, which may be differential electrical connector pairs, in a three-dimensional manner throughout a backplane footprint, a backplane connector, and/or a daughtercard footprint. These encapsulating ground structures, along with a dielectric filler of the differential cavities surrounding the electrical connector pairs themselves, may prevent undesirable propagation of non-traverse, longitudinal, and higher-order modes during operation of the high-speed backplane connector systems.

Figure 2:
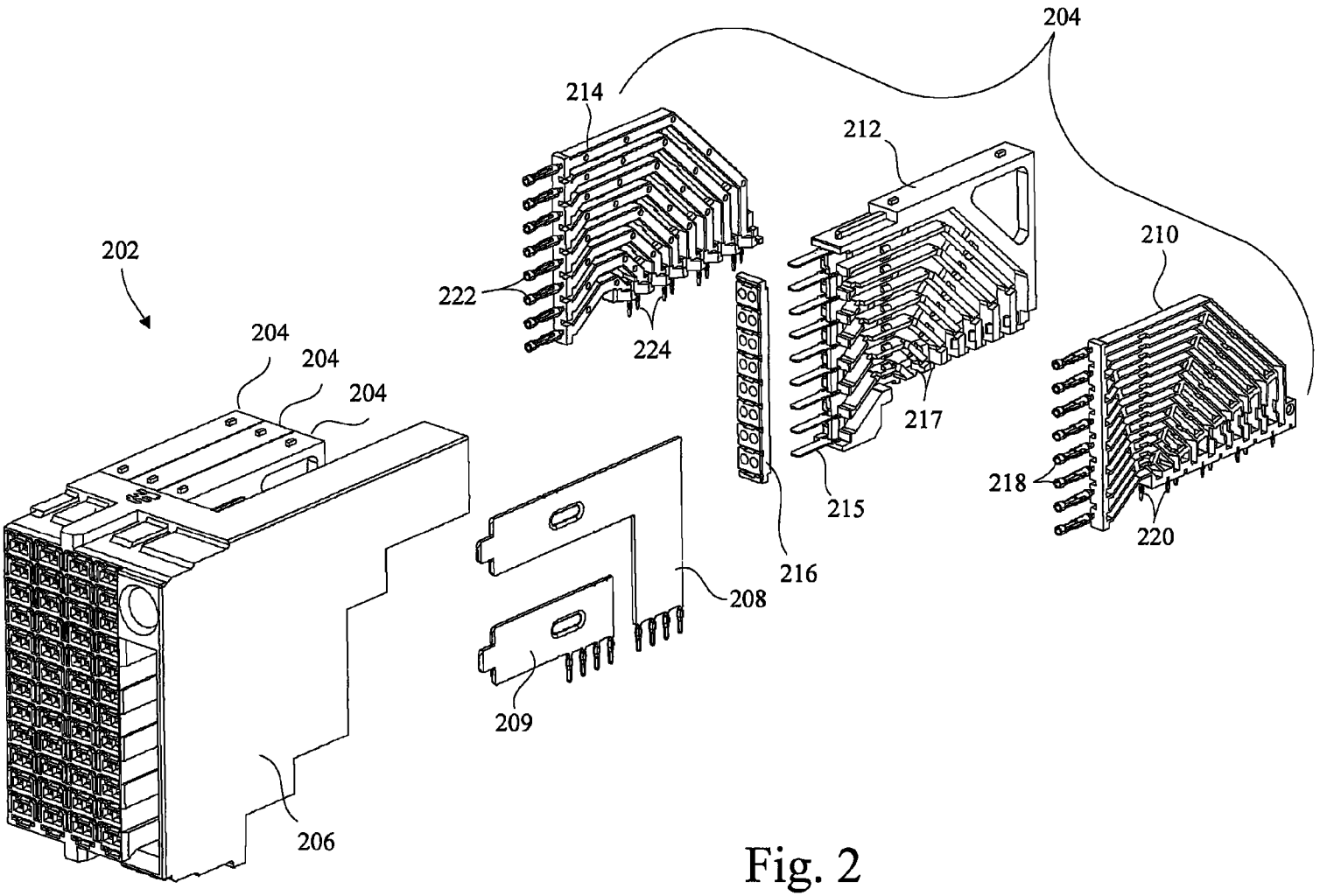
FIG. 2 is a perspective view of an electrical connector system that includes multiple wafer assemblies.

FIG. 2 is a perspective view of an electrical connector system 202 for connecting multiple substrates. In one implementation, the electrical connector system 202 defines a mounting end that connects with a first substrate and a mating end that connects with a second substrate. The connections with the first substrate or the second substrate may be direct or through an interfacing connector. In some implementations, the first and second substrates may be arranged in a substantially perpendicular relationship when engaged with the electrical connector system 202.

The electrical connector system 202 may include one or more wafer assemblies 204 that provide electrical paths between the two substrates. Each of the wafer assemblies 204 may include a first array of electrical contacts 210 (also known as a first lead frame assembly), a center frame 212, a second array of electrical contacts 214 (also known as a second lead frame assembly), one or more ground tabs 215, and an organizer 216. The arrays of electrical contacts 210 and 214 may each be configured to connect with a first substrate and a second substrate to provide a plurality of electrical paths between the first substrate and the second substrate. The electrical paths may be signal transmission paths, power transmission paths, or ground potential paths.

The center frame 212 of a wafer assembly 204 may be a housing component that accommodates an array of electrical contacts 210 and 214 on each side of the center frame 212. A first side face of the center frame 212 may comprise a conductive surface that defines a plurality of first channels 217. Similarly, a second side face of the center frame 212 may also comprise a conductive surface that defines a plurality of second channels. Although the second channels on the second side of the center frame 212 are not visible in the view of FIG. 2, they may be substantially similar to the plurality of first channels 217 shown on the first side of the center frame 212.

In some implementations, each of the channels of the center frame 212 is lined with an insulation layer, such as an overmolded plastic dielectric, so that when the arrays of electrical contacts 210 and 214 are positioned substantially within the channels, the insulation layer electrically isolates conductive portions of the arrays of electrical contacts 210 and 214 from the conductive surface of the center frame 212. In other implementations, the arrays of electrical contacts 210 and 214 are at least partially surrounded by an overmolded insulation layer to isolate the conductive leadframe within the arrays of electrical contacts 210 and 214 from other conductive surfaces, such as the channels of the center frame 212.

Figure 3:
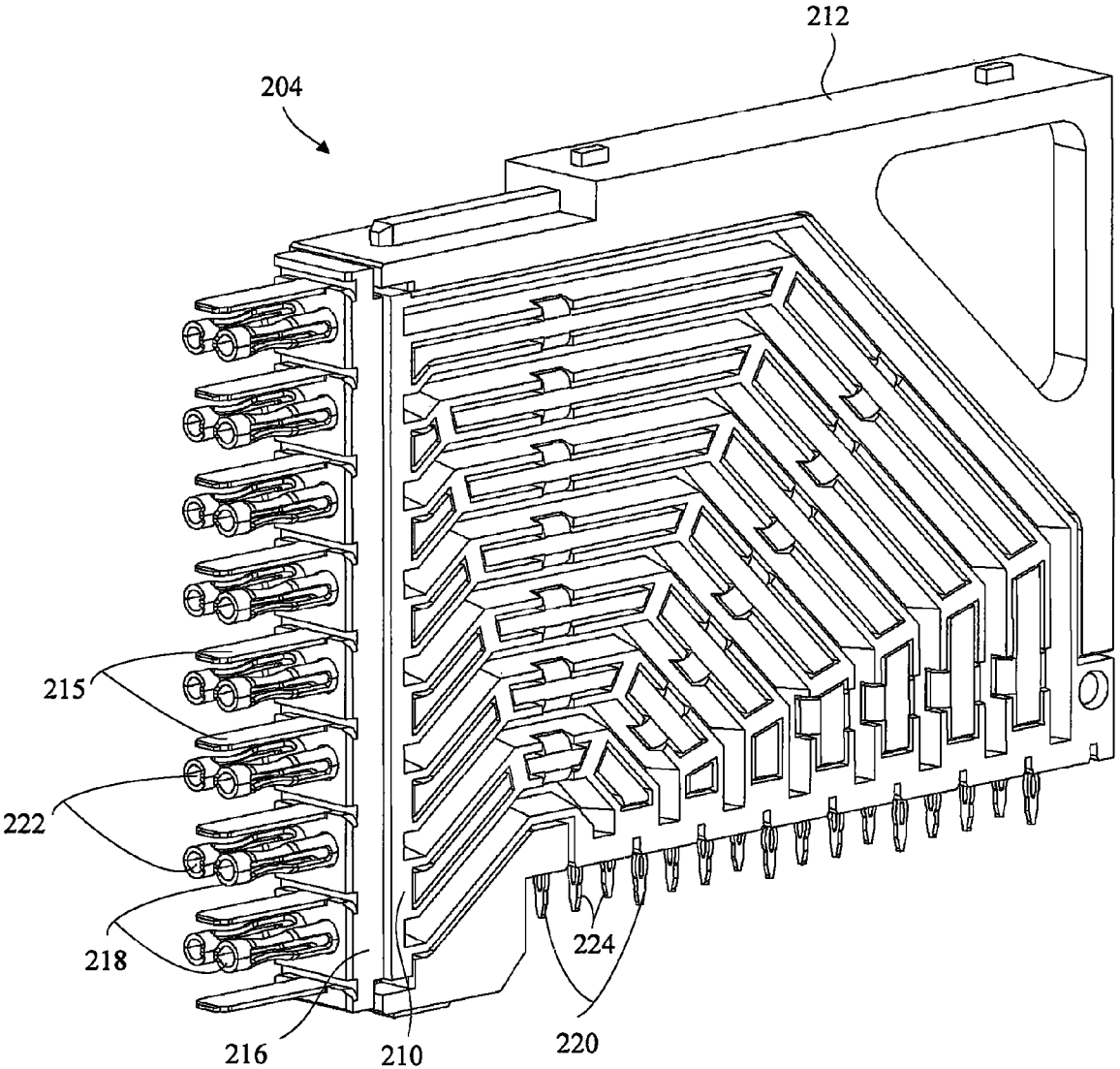
FIG. 3 shows a wafer assembly of the electrical connector system of FIG. 2.

FIG. 3 shows one of wafer assemblies 204 after the arrays of electrical contacts 210 and 214, and the organizer 216, have been connected with the center frame 212. The array of electrical contacts 210 may be positioned substantially within the plurality of first channels 217 of the first side of the center frame 212 and the array of electrical contacts 214 is positioned substantially within the plurality of channels of the second side of the center frame 212. When positioned within the channels of the center frame 212, each electrical contact of the array of electrical contacts 210 is positioned adjacent to a corresponding electrical contact of the array of electrical contacts 214. In some implementations, the arrays of electrical contacts 210 and 214 are positioned in the channels of the center frame 212 such that a distance between adjacent electrical contacts is substantially the same throughout the wafer assembly 204. Together, the adjacent electrical contacts of the arrays of electrical contacts 210 and 214 form a series of electrical contact pairs. For example, in FIG. 3, the wafer assembly 204 includes eight pairs of electrical contacts. Each pair of contacts includes one contact from the array of electrical contacts 210 and one contact from the array of electrical contacts 214. In some implementations, the electrical contact pairs may be differential pairs of electrical contacts. For example, the electrical contact pairs may be used for differential signaling.

In some implementations, for each electrical contact pair, the electrical contact of one array of electrical contacts mirrors the adjacent electrical contact of the other array of electrical contacts. Mirroring the electrical contacts of the electrical contact pair may provide advantages in manufacturing as well as column-to-column consistency for high-speed electrical performance, while still providing a unique structure in pairs of two columns.

Referring to FIGS. 2 and 3, the first array of electrical contacts 210 may define a plurality of electrical mating connectors 218 at a mating end of the wafer assembly 204 and a plurality of mounting connectors 220 at a mounting end of the wafer assembly 204. Similarly, the second array of electrical contacts 214 may define a plurality of electrical mating connectors 222 at a mating end of the wafer assembly 204 and a plurality of mounting connectors 224 at a mounting end of the wafer assembly 204. The mating connectors 218 and 222 may be closed-band shaped, tri-beam shaped, dual-beam shaped, circular shaped, male, female, hermaphroditic, or another mating connector style. The mounting connectors 220 and 224 may be substrate engagement elements, such as electrical contact mounting pins that are dimensioned to fit into corresponding holes or vias in the substrate to make connection with the substrate.

When the arrays of electrical contacts 210 and 214 are positioned within the channels of the center frame 212, the electrical mating connectors 218 and 222 extend out from one end of channels of the center frame 212 at the mating end of the wafer assembly 204 to couple with a first substrate or another mating device, such as a header module. Similarly, when the arrays of electrical contacts 210 and 214 are positioned within the channels of the center frame 212, the mounting connectors 220 and 224 extend out from the other end of channels of the center frame 212 at the mounting end of the wafer assembly 204 to couple with a second substrate or another mating device. In the array of electrical contacts 210, one of the mating connectors 218 may be located at one end of each electrical path of the array, and one of the mounting connectors 220 may be located at the other end of each electrical path of the array. Similarly, in the array of electrical contacts 214, one of the mating connectors 222 may be located at one end of each electrical path of the array, and one of the mounting connectors 224 may be located at the other end of each electrical path of the array.

Figure 4:
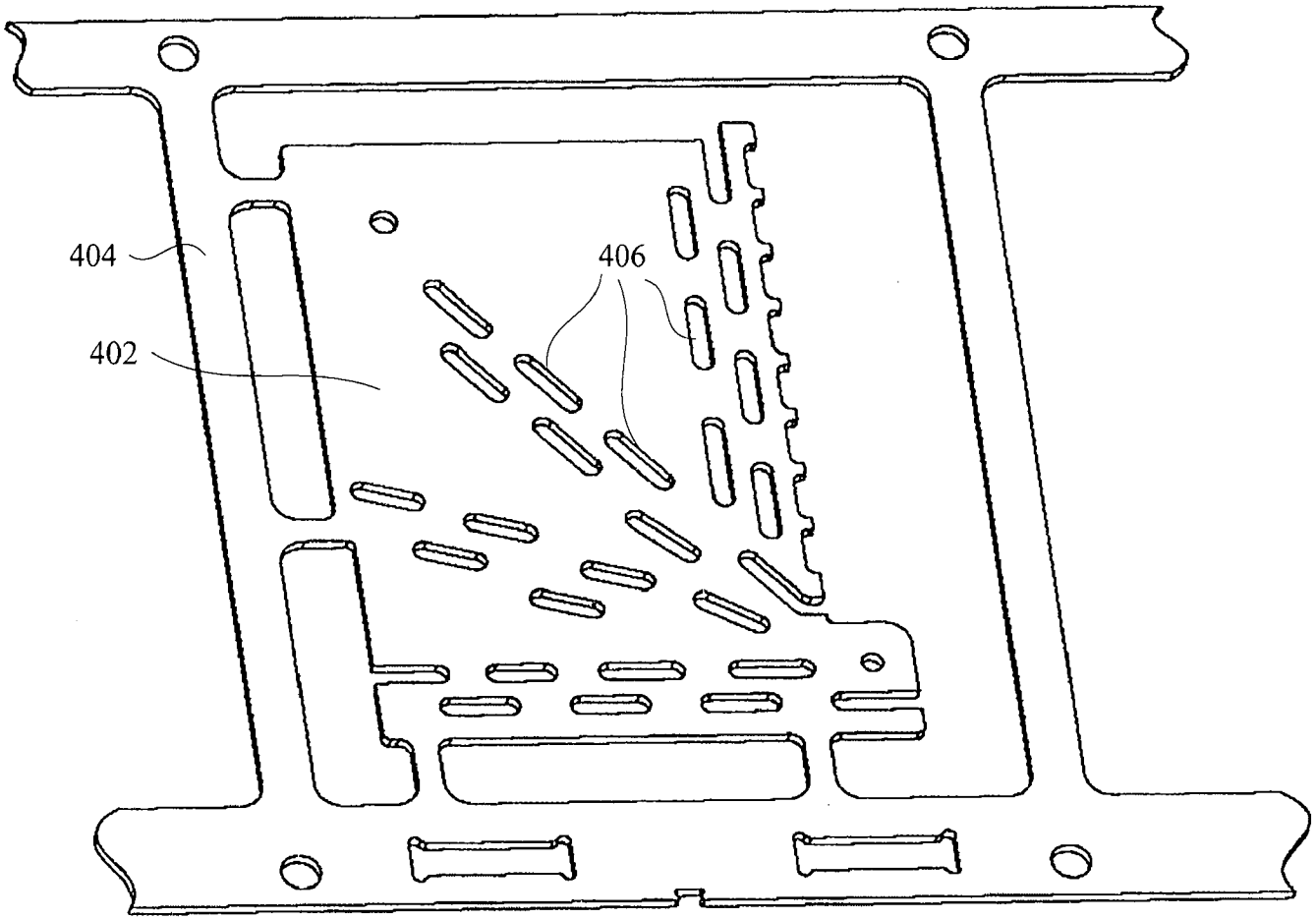
FIG. 4 shows a metal center ground plane of the wafer assembly of FIG. 3.

FIG. 4 shows a stamped metal center ground plane 402 of the center frame 212 of FIGS. 2 and 3. The metal center ground plane 402 may be formed from Brass, Phosphor Bronze, or another center ground plane material. The metal center ground plane 402 in FIG. 4 is shown with a manufacturing frame 404 that is removed before operation. The metal center ground plane 402 may include a plurality of holes 406 that pass from a first side face of the metal center ground plane 402 to a second side face of the metal center ground plane 402. The holes 406 serve to allow passage of a plastic molding material through the metal center ground plane 402 during an overmolding process that forms the channels 217 of the center frame 212.

Figure 5:
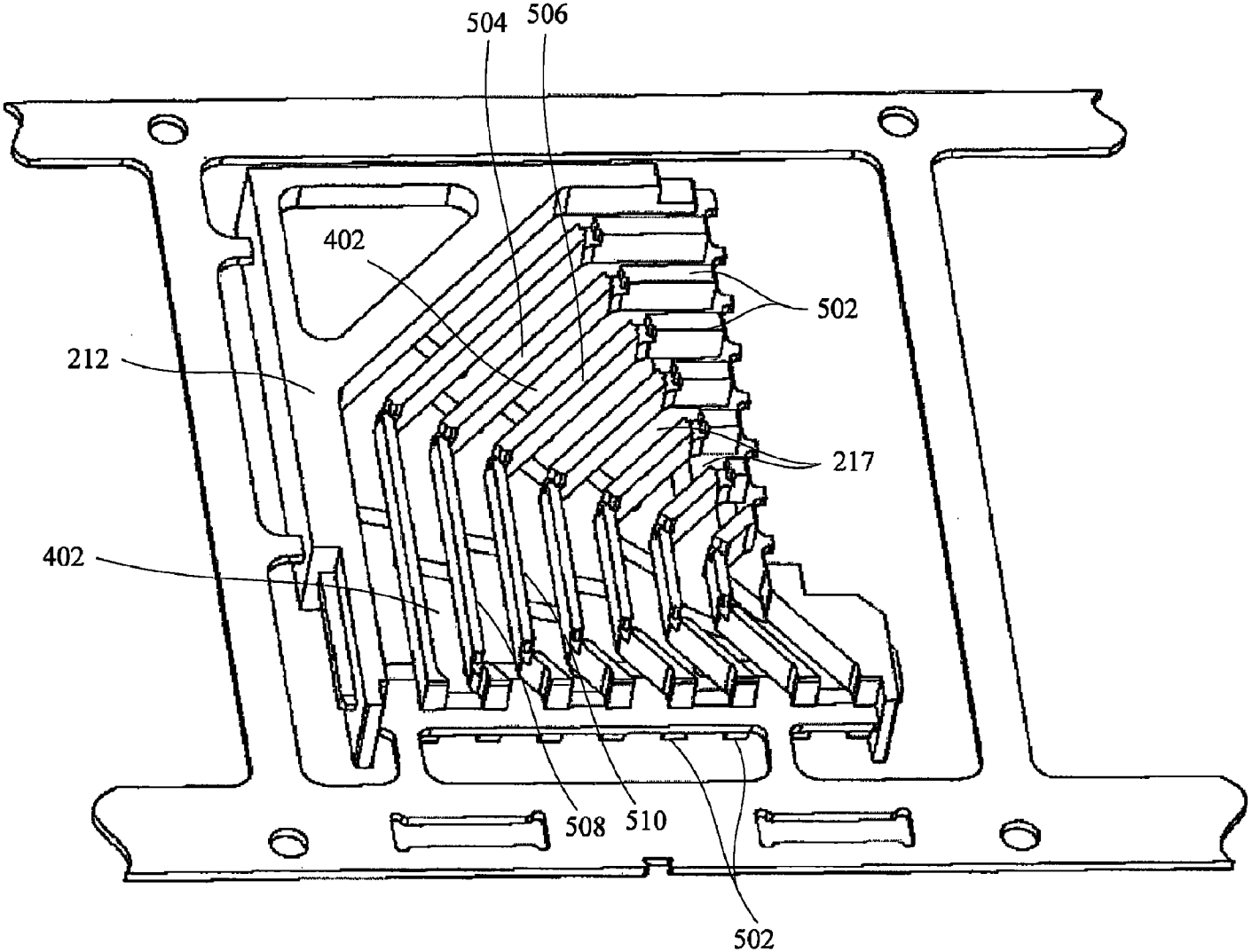
FIG. 5 shows a plurality of ribs overmolded on the metal center ground plane of FIG. 4.

FIG. 5 shows the center frame 212 after the channels 217 have been formed onto the metal center ground plane 402 of FIG. 4. In some implementations, the channels 217 are defined by a plurality of plastic ribs 502. The plastic ribs 502 may be plated with a conductive material or may be formed of a conductive plastic. The plastic ribs 502 may be formed from a liquid crystal polymer ("LCP"), a high temperature thermoplastic, or another rib material. The plastic ribs 502 are overmolded onto the metal center ground plane 402 in a configuration that forms the channels 217 on the metal center ground plane 402.

In some implementations, the plastic ribs 502 may be overmolded on a first side face of the metal center ground plane 402 to form a plurality of first electrical contact channels 217 on the first side face of the metal center ground plane 402. A first array of electrical contacts may then be positioned substantially within the plurality of first electrical contact channels 217. The overmolded plastic ribs 502 may also be formed on a second side face of the metal center ground plane 402 in a configuration that forms a plurality of second electrical contact channels on the second side face of the metal center ground plane 402. A second array of electrical contacts may then be positioned substantially within the plurality of second electrical contact channels. Although the majority of the plastic ribs 502 on the second side of the metal center ground plane 402 are not visible in the view of FIG. 5, the ribs 502 on the second side may be substantially similar to the ribs 502 on the first side of the metal center ground plane 402. Therefore, the ribs 502 on the first side may be aligned relative to the ribs 502 on the second side such that each electrical contact of the first array of electrical contacts is positioned adjacent to a corresponding electrical contact of the second array of electrical contacts to form a plurality of differential pairs of electrical contacts.

In one implementation, the metal center ground plane 402 may be exposed at the bottom of each channel 217 in the center frame 212. For example, a channel 217 of the center frame 212 may be defined between a first plastic rib portion 504 and a second plastic rib portion 506. The first and second plastic rib portions 504 and 506 may be overmolded onto the metal center ground plane 402 such that a portion of the metal center ground plane 402 may be exposed between the first plastic rib portion 504 and the second plastic rib portion 506. In some implementations, after the plastic ribs 502 have been formed on the metal center ground plane 402, the metal center ground plane 402 may be electrically connected with one or more conductive surfaces of the plastic ribs 502 on one or both sides of the center frame 212.

As shown in FIG. 5, a portion of one of the channels 217 of the center frame 212 may be defined by a rib portion 504, a rib portion 506, a rib portion 508, and a rib portion 510. Additionally, other rib portions may also help define the full channel 217, as shown in FIG. 5. The rib portion 504 and the rib portion 508 form a portion of a first wall on one side of the channel 217. Similarly, the rib portion 506 and the rib portion 510 form a portion of a second wall on an opposing side of the channel 217. As shown in FIG. 5, the rib portion 504 may be substantially parallel with the rib portion 506 on the other side of the channel 217. The rib portion 508 may be substantially parallel with the rib portion 510 on the other side of the channel 217. As shown in FIG. 5, the rib portion 504 is not substantially parallel with the rib portion 510, and the rib portion 506 is not substantially parallel with the rib portion 508. Therefore, the channels 217 of FIG. 5 use a change of direction by the overmolded rib portions to accommodate arrays of electrical contacts that connect with two substrates that may be substantially perpendicular. The channels 217 may have other dimensions, arrangements, and configurations. For example, the channels 217 may be customized to the dimensions and configurations of the arrays of electrical contacts used to connect multiple substrates in the electrical connector 202.

Referring back to FIGS. 2 and 3, a plurality of ground tabs 215 may be positioned at the mating end of the wafer assembly 204. The ground tabs 215 extend out from the center frame 212 and may be electrically connected to the first side and/or the second side of the central frame 212. The ground tabs 215 may be paddle shaped or any other shape that shields adjacent electrical contacts. In one implementation, one of the ground tabs 215 is positioned above each electrical connector pair at the mating end of the wafer assembly 204 and another of the ground tabs 215 is positioned below each electrical connector pair. In some implementations, the ground tabs 215 comprise tin (Sn) over nickel (Ni) plated brass or other electrically conductive platings or base metals.

Like the ground tabs 215, the organizer 216 may be positioned at the mating end of the wafer assembly 204. The organizer 216 comprises a plurality of apertures dimensioned to allow the ground tabs 215 and the electrical mating connectors 218 and 222 extending from the wafer assembly 212 to pass through the organizer 216 when the organizer 216 is positioned at the mating end of the wafer assembly 204. In some implementations, the organizer 216 serves to securely lock the center frame 212, the first array of electrical contacts 210, the second array of electrical contacts 214, and the ground tabs 215 together.

Referring to FIG. 2, the electrical connector system 202 may also include a wafer housing 206. The wafer housing 206 serves to receive and position multiple wafer assemblies 204 adjacent to one another within the electrical connector system 202. In one implementation, the wafer housing 206 engages with each of the wafer assemblies 204 at the mating end of the wafer assemblies 204. For example, the wafer housing 206 may accept the ground tabs 215 and the electrical mating connectors 218 and 222 extending from the plurality of wafer assemblies 204. This connection between the wafer housing 206 and the wafer assemblies 204 positions each of the wafer assemblies 204 adjacent to another of the wafer assemblies 204. The dimensions of the interfacing connector of the wafer housing 206 define the relative spacing of multiple wafer assemblies 204.

As shown in FIG. 2, the electrical connector system 202 may also include one or more power contacts 208 and 209 that are positioned external to the individual wafer assemblies 204. The power contacts 208 and 209 are dimensioned to pass through one or more openings in the wafer housing 206. The power contacts 208 and 209 serve to provide one or more power transmission paths between the two substrates connected with the electrical connector system 202.

Figure 6:
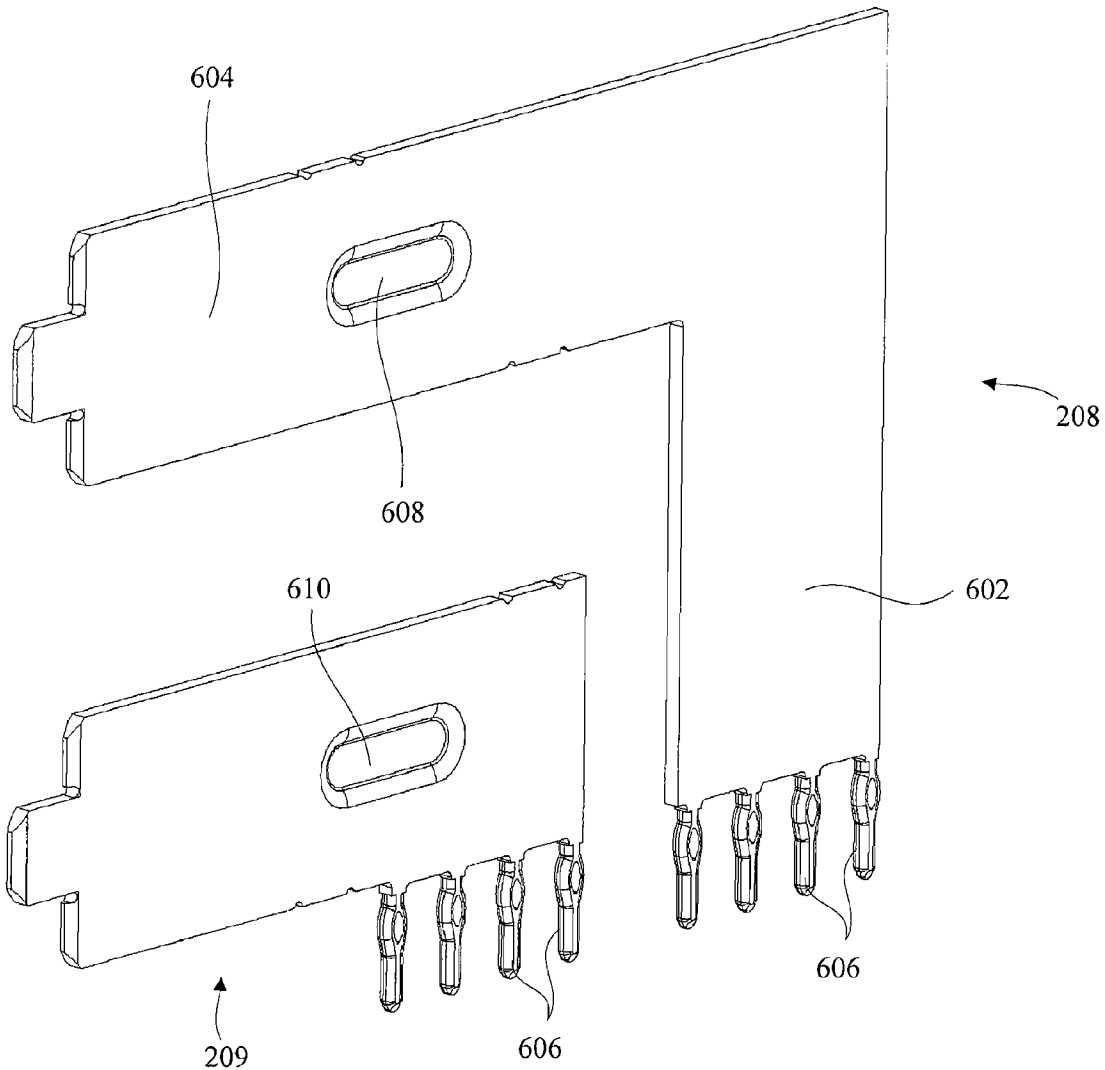
FIG. 6 is an enlarged view of the power contacts from the electrical connector system of FIG. 2.

FIG. 6 shows an enlarged view of the power contacts 208 and 209 of FIG. 2. As seen in FIG. 6, the power contact 208 includes a first portion 602 configured to engage with a first substrate and a second portion 604 dimensioned to pass through the aligned openings in the wafer housing 206 and the header module 902 and connect with a second substrate. As shown in FIG. 6, the first portion 602 may be substantially perpendicular to the second portion 604. In this implementation, the first portion 602 is positioned relative to the second portion 604 so that the power contacts 208 and 209 may connect with two substrates that may be substantially perpendicular. Each of the power contacts 208 and 209 may also include one or more substrate engagement elements 606, such as electrical contact mounting pins that are dimensioned to fit into corresponding holes or vias in the substrate to make connection with the substrate.

Figure 7:
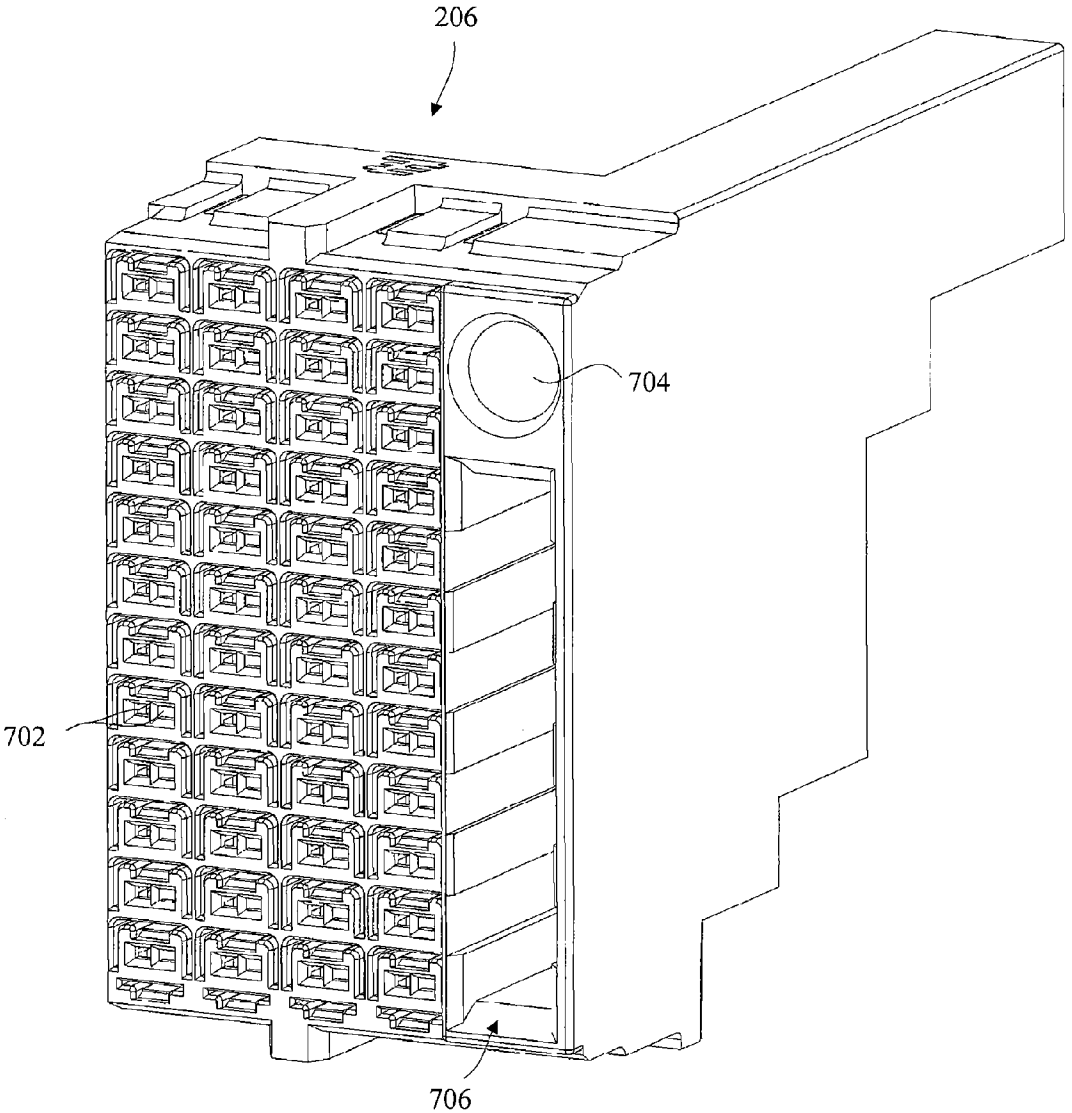
FIG. 7 is an enlarged view of the wafer housing from the electrical connector system of FIG. 2.
Figure 8:
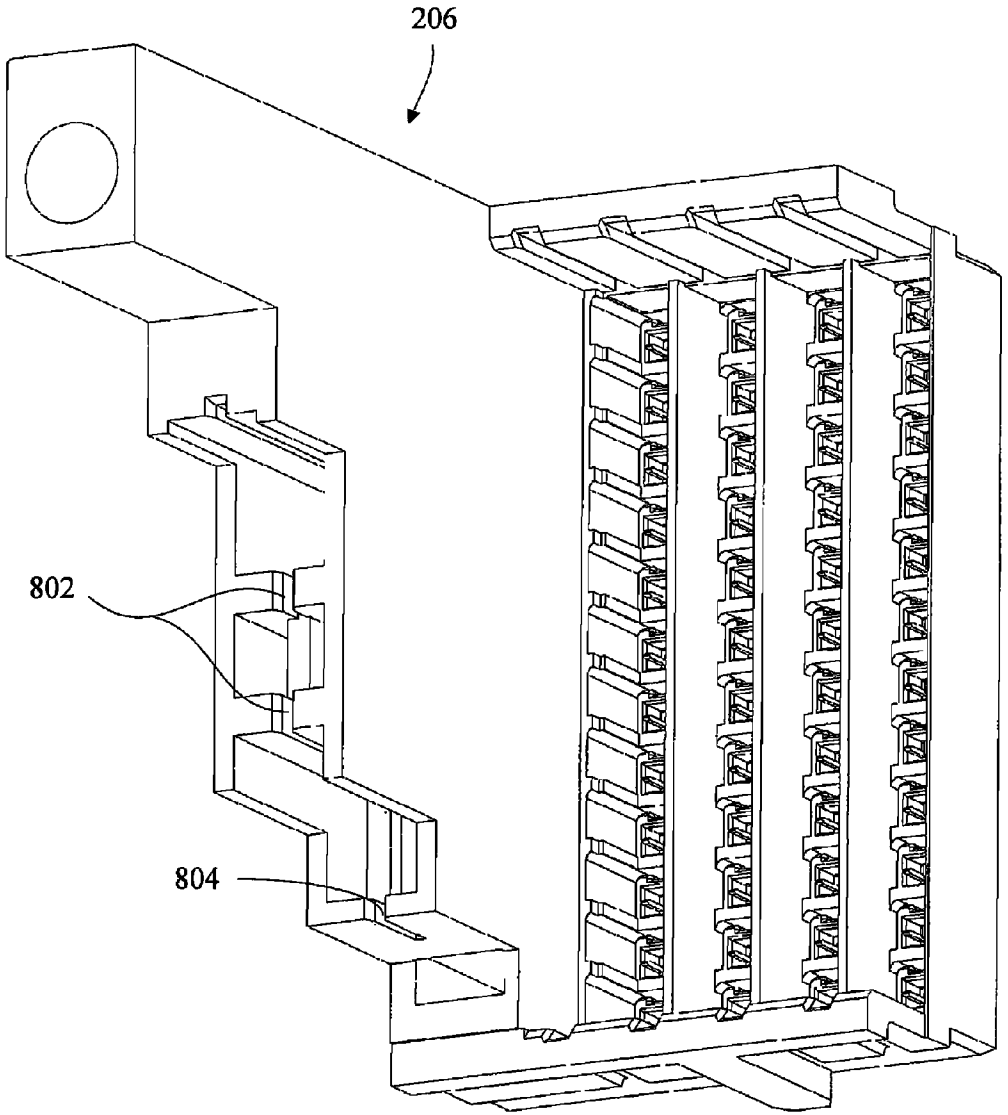
FIG. 8 is an alternative view of the wafer housing of FIG. 7.

FIGS. 7 and 8 show alternative views of the wafer housing 206 of the electrical connector system 202 from FIG. 2. The wafer housing 206 includes one or more apertures 702 in the wafer housing 206 that are dimensioned to allow mating connectors 218 and 222 extending from the wafer assemblies 204 to connect with corresponding mating connectors associated with a substrate or another mating device, such as the header modules 902 shown in FIGS. 9-12.

As shown in FIG. 7, the wafer housing 206 may also include a guidance component 704 and an opening 706 dimensioned to receive component portions of a header module 902. FIG. 8 shows the opposite side of the wafer housing 206 of FIG. 7. In FIG. 8, the wafer housing 206 is shown with one or more slots 802 and 804 dimensioned to receive the power contacts 208 and 209. For example, the slot 802 may receive the power contact 208, and the slot 804 may receive the power contact 209. The power contacts 208 and 209 may include one or more raised surface portions 608 and 610, as shown in FIG. 6, that provide an interference fit between the power contacts 208 and 209 and the wafer housing 206 when the power contacts 208 and 209 are placed into the slots 802 and 804 of the wafer housing 206.

FIGS. 9-12 show various views of a header module 902 adapted to mate with the wafer housing 206 of FIGS. 7 and 8. In one implementation, the header module 902 serves as an interfacing connection component between the wafer housing 206 and a substrate. The header module 902 may include a frame 904, an opening 906, and slots 908 and 910.

Figure 9:
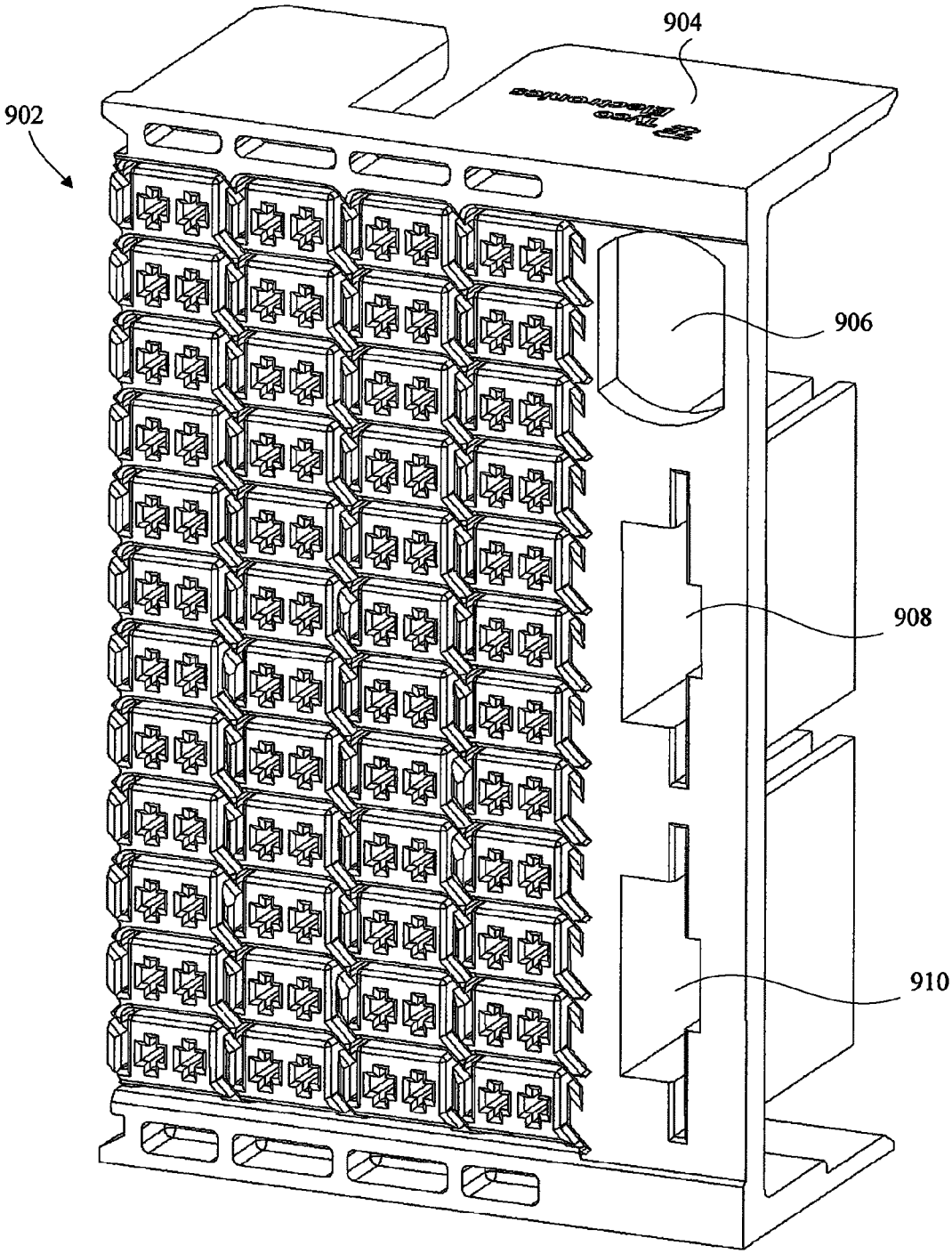
FIG. 9 shows a header module that engages with the wafer housing of FIG. 7.
Figure 10:
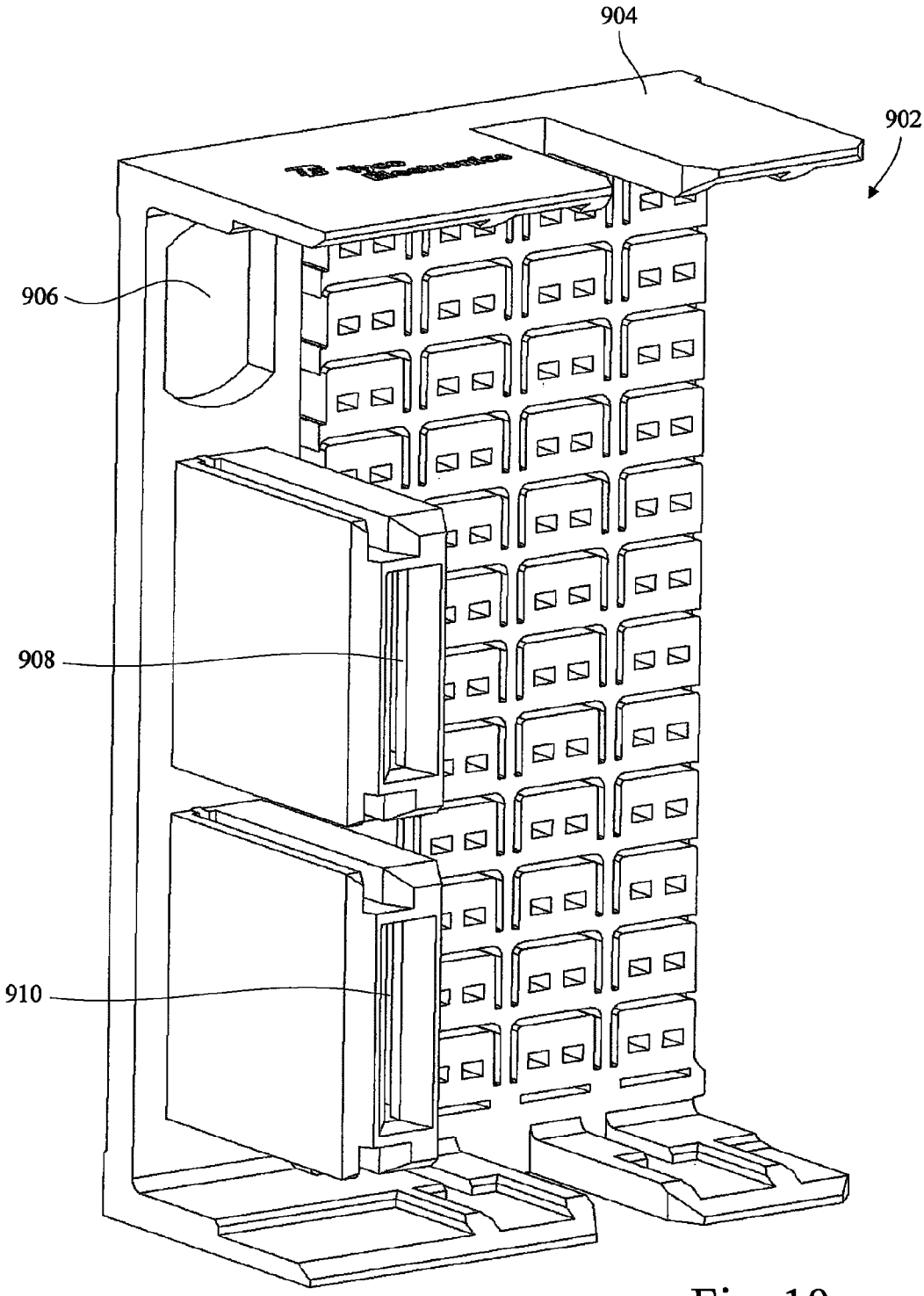
FIG. 10 is an alternative view of the header module of FIG. 9.

The portion of the frame 904 that forms the slots 908 and 910 may project out from the back side of the header module 902, as shown in FIGS. 9 and 10. These projections may fit within the opening 706 of the wafer housing 206 when the header module 902 engages with the wafer housing 206. When the header module 902 is engaged with the wafer housing 206, the slots 908 and 910 in the frame 904 of the header module 902 align with the slots 802 and 804 of the wafer housing 206 of FIGS. 7 and 8. After the wafer housing 206 and the header module 902 are engaged together, the power contacts 208 and 209 of FIG. 2 are dimensioned to pass through the aligned slots to provide a power transmission path between two substrates. For example, the power contact 208 may pass through the slot 802 of the wafer housing 206 and the slot 908 of the header module 902. Similarly, the power contact 209 may pass through the slot 804 of the wafer housing 206 and the slot 910 of the header module 902.

Figure 11:
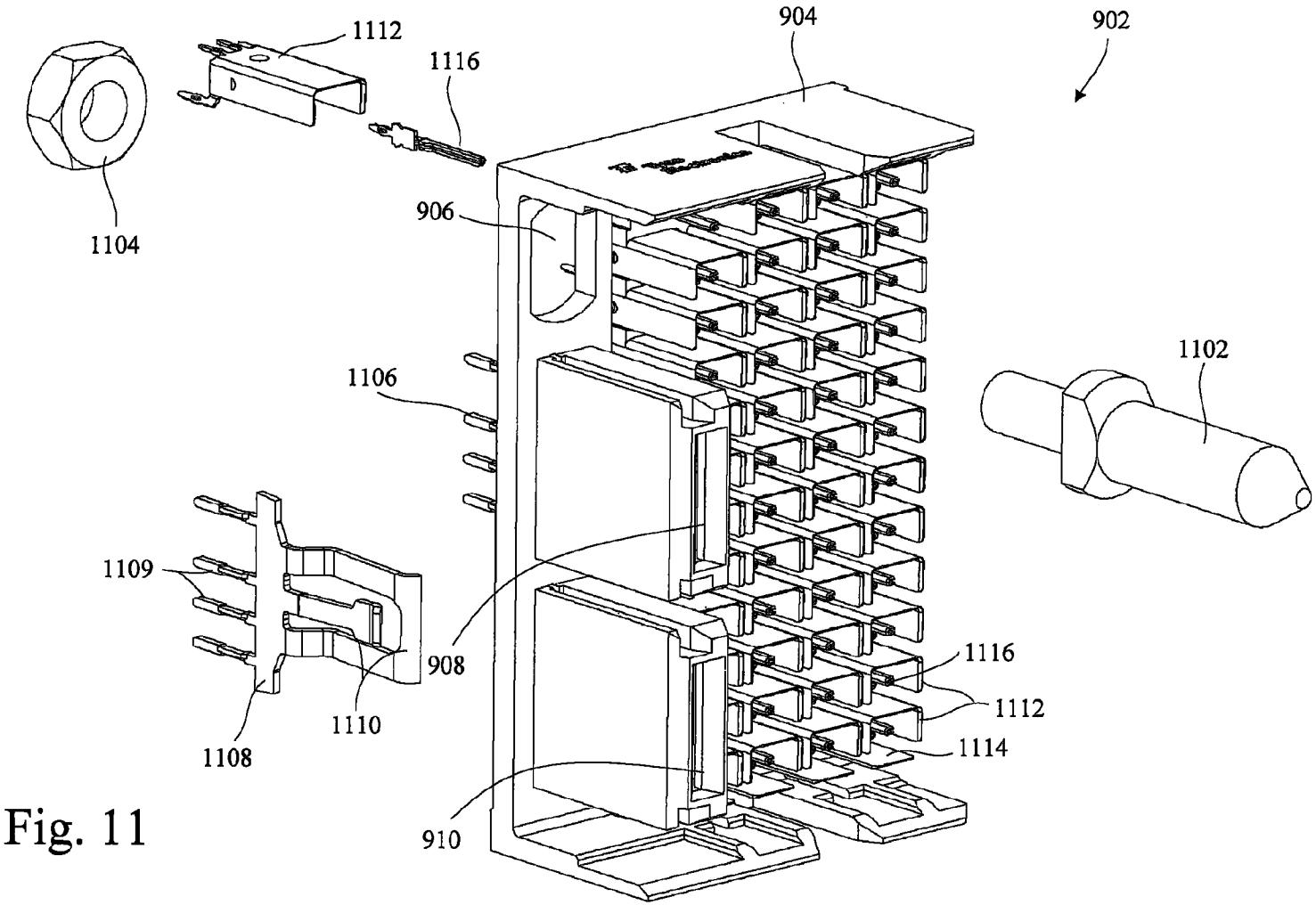
FIG. 11 shows another view of a header module.

As shown in FIG. 11, the header module 902 may also include power contact interfacing connectors 1106 and 1108. One end of the power contact interfacing connectors 1106 and 1108 includes substrate engagement elements 1109, such as electrical contact mounting pins that are dimensioned to fit into corresponding holes or vias in the substrate to make connection with the substrate. The other end of the power contact interfacing connectors 1106 and 1108 may include a tab connector system 1110 to create a press fit or interference fit between the power contact interfacing connectors 1106 and 1108 and the respective power contacts 208 and 209. One of the tabs of the tab connector system 1110 is designed to abut a first side face of a power contact, and another tab of the tab connector system 1110 is designed to abut a second side face of the power contact.

Figure 12:
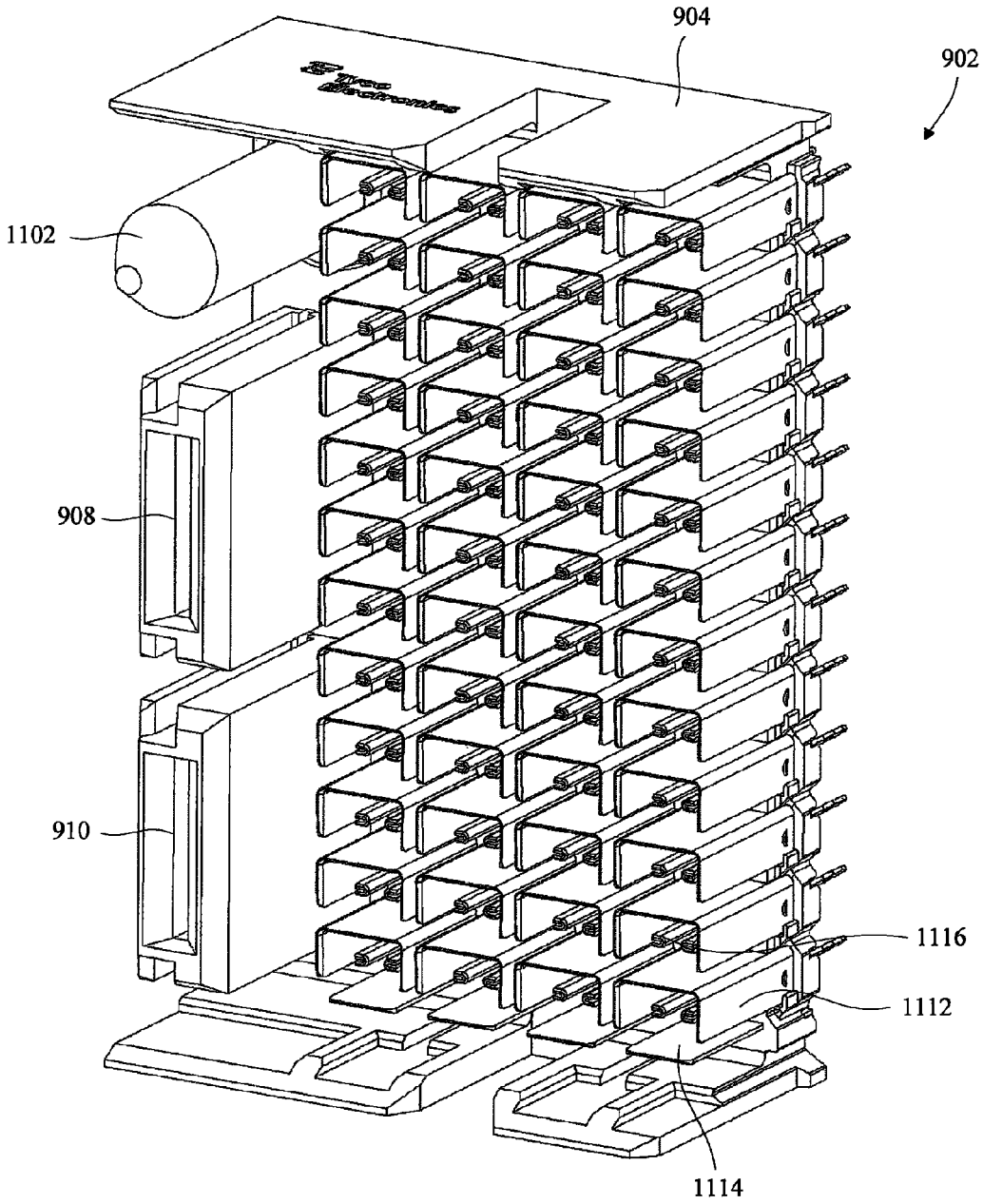
FIG. 12 shows yet another view of a header module.

The opening 906 in the frame 904 provides a location for a guidance component 1102 to be connected to the header module 902, as shown in FIGS. 11 and 12. In one implementation a fastener 1104 engages the guidance component 1102 to hold the guidance component 1102 in place relative to the frame 904 of the header module 902. The guidance component 1102 may work with the corresponding guidance component 704 of the wafer housing 206 of FIG. 7 to improve mating alignment between the wafer housing 206 and the header module 902. In one implementation, guidance component 1102 of the header module 902 may comprise a guidance post and the guidance component 704 of the wafer housing 206 may comprise a guidance cavity that receives the guidance post when the wafer housing 206 mates with the header module 902. Generally, the guidance component 1102 of the header module 902 and corresponding guidance component 704 of the wafer housing 206 engage to provide initial positioning before the wafer housing 206 mates with the header module 902. For example, the guidance system may align the header module 902 with the wafer housing 206 before signal pins 1116 of the header module 902 engage with corresponding mating connectors 218 and 222 of the arrays of electrical contacts 210 and 214. The guidance component 1102 may connect with the frame 904 of the header module 902, as shown in FIG. 11, or the guidance component 1102 may be an integral portion of the frame 904. Similarly, the guidance component 704 may be an integral portion of the frame of the wafer housing 206, as shown in FIG. 7, or the guidance component 704 may be affixed to the frame of the wafer housing 206.

As shown in FIGS. 11 and 12, a mating face of the header module 902 may include a plurality of C-shaped ground shields 1112, a row of ground tabs 1114, and a plurality of signal pins 1116 organized into signal pin pairs. The signal pins 1116 are coupled with the mating connectors 218 and 222 of the wafer assemblies 204 when the wafer assemblies 204, the wafer housing 206, and the header module 902 are all engaged. In some implementations, the configuration, assembly, and use of the C-shaped ground shields 1112, the row of ground tabs 1114, and the plurality of signal pin pairs 1116 of the header module 902 is the same as the configuration, assembly, and use of the corresponding features of the header module described in U.S. patent application Ser. No. 12/474,568, which is incorporated by reference.

Figure 13:
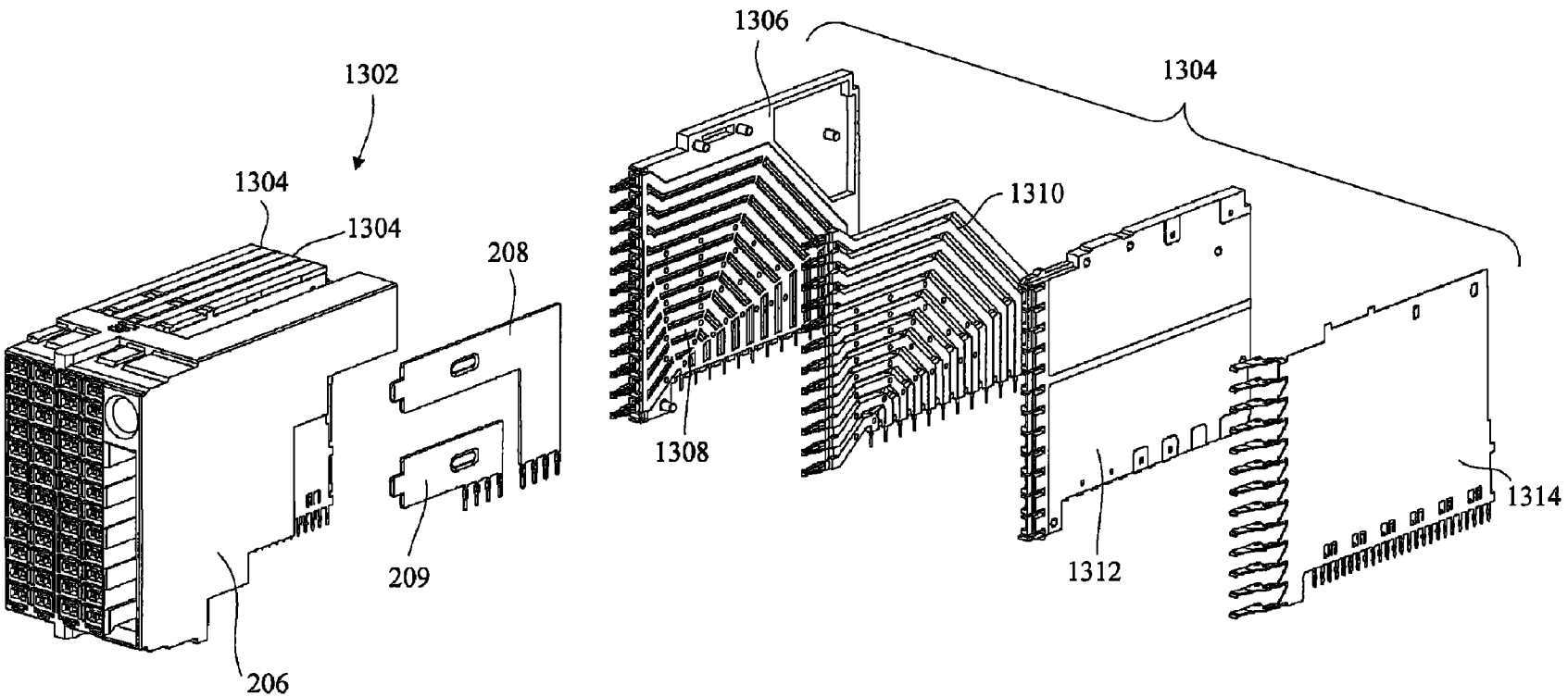
FIG. 13 is a perspective view of an alternative electrical connector system that includes multiple wafer assemblies.
Figure 14:
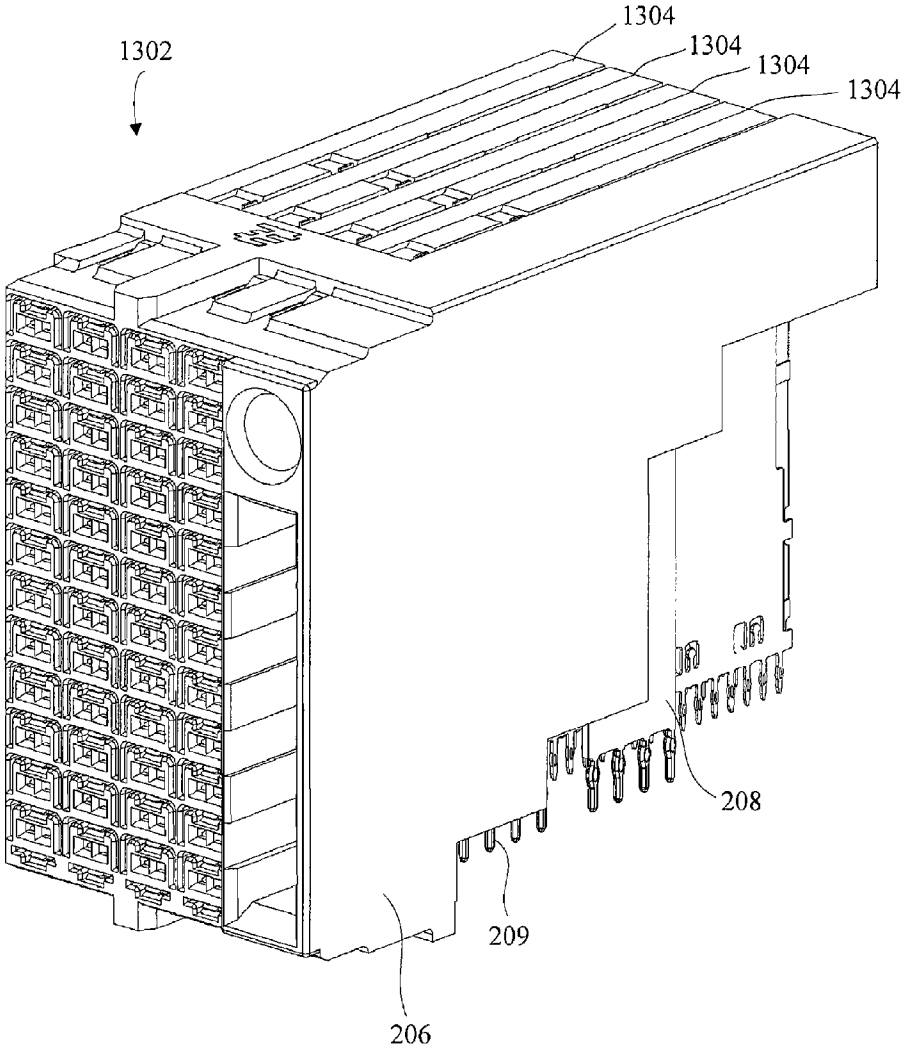
FIG. 14 is another view of the electrical connector system of FIG. 13.

FIG. 13 is a perspective view of an electrical connector system 1302 for connecting multiple substrates. Like the electrical connector system 202, the electrical connector system 1302 may include one or more wafer assemblies 1304, a wafer housing 206, and power contacts 208 and 209. FIG. 14 shows the electrical connector system 1302 after the wafer assemblies 1304 have been assembled and engaged with the wafer housing 206. One difference between the electrical connector system 1302 and the electrical connector system 202 is that the wafer assemblies 1304 in FIG. 13 are different than the wafer assemblies 204 in FIG. 2. In the electrical connector system 1302, a wafer assembly 1304 may include a first housing 1306, an array of electrical contacts 1308, an array of electrical contacts 1310, a second housing 1312, and a ground shield 1314.

Figure 15:
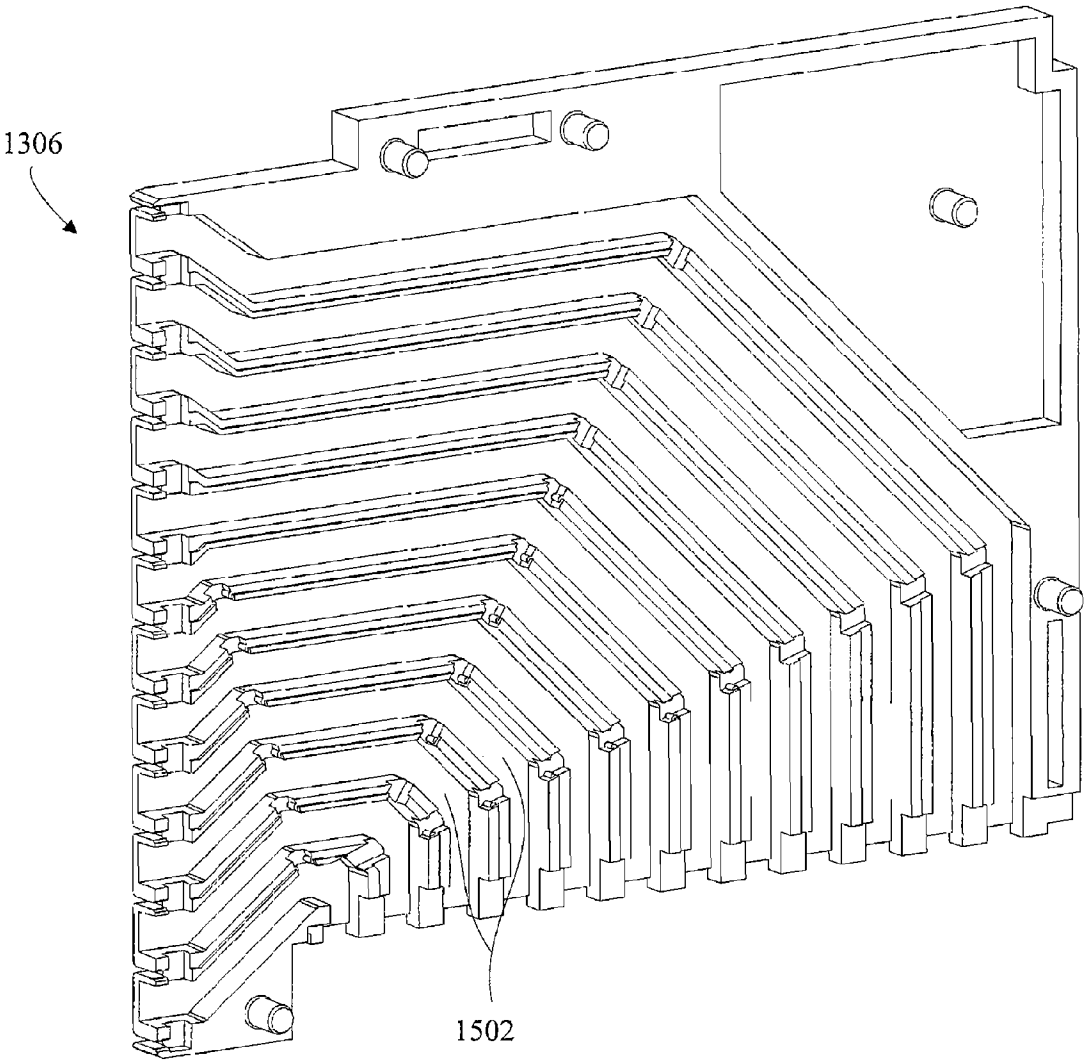
FIG. 15 shows a housing component from the electrical connector system of FIG. 13.
Figure 16:
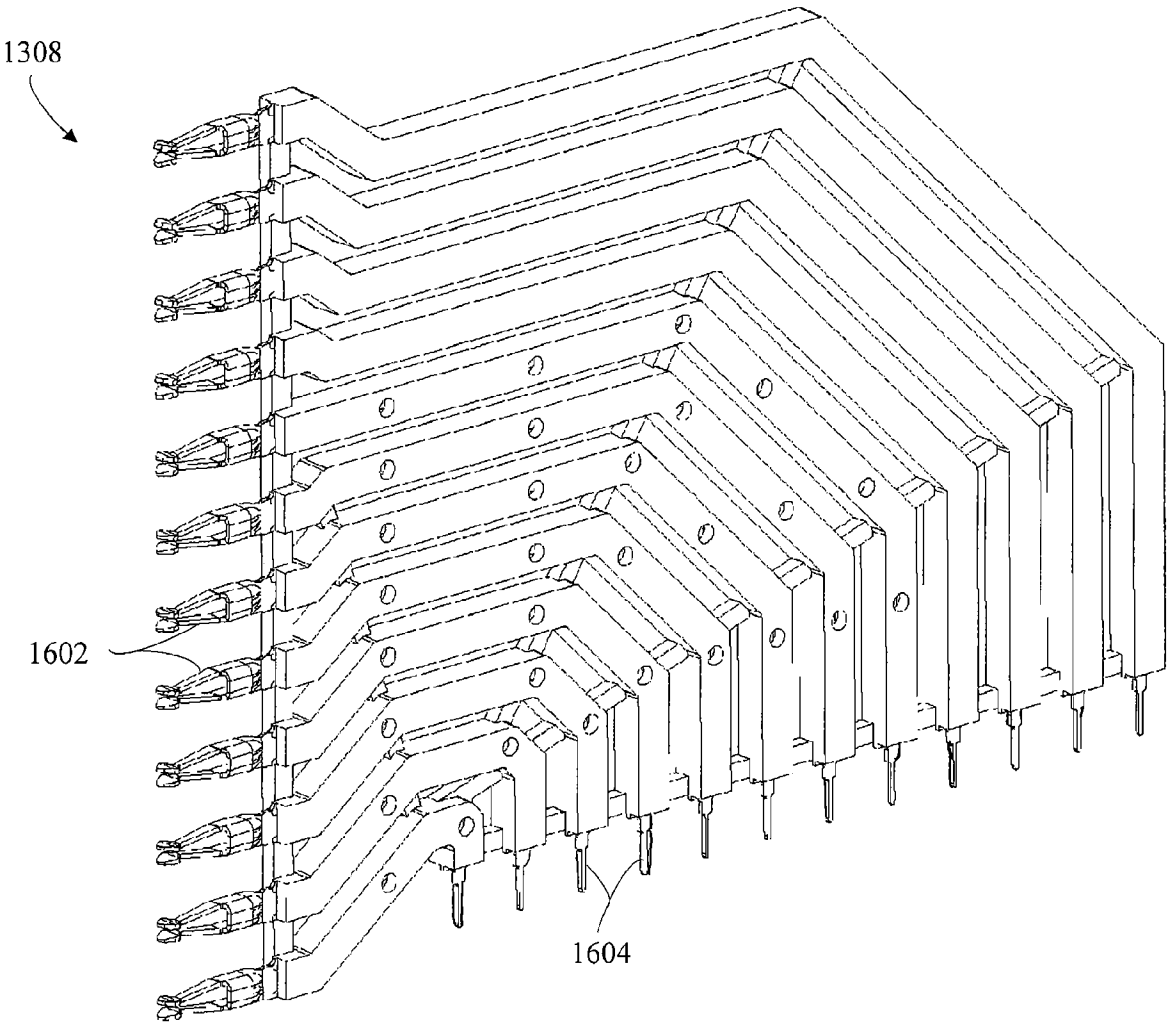
FIG. 16 shows an array of electrical contacts from the electrical connector system of FIG. 13.

In some implementations, the configuration, assembly, and use of the first housing 1306, the array of electrical contacts 1308, the array of electrical contacts 1310, the second housing 1312, and the ground shield 1314 of the electrical connector system 1302 is the same as the configuration, assembly, and use of the corresponding features of the electrical connector system described in connection with FIGS. 41-47 in U.S. patent application Ser. No. 12/474,568, which is incorporated by reference. For example, as shown in FIG. 15, the housing component 1306 may define a plurality of channels 1502 dimensioned to receive one or more arrays of electrical contacts. FIG. 16 shows an array of electrical contacts 1308 dimensioned to fit within the plurality of channels 1502 of the housing component 1306 of FIG. 15. As described in U.S. patent application Ser. No. 12/474,568, and similar to the arrays of electrical contacts 210 and 214 described above, the array of electrical contacts 1308 includes a plurality of mating connectors 1602 and a plurality of mounting connectors 1604 for connecting multiple substrates.

Each of the wafer assemblies 1304 includes a housing (e.g., the housing 1306 or the housing 1312) with a face that separates electrical contact arrays 1308 and 1310 in the wafer assembly 1304 from electrical contact arrays in adjacent wafer assemblies. As described above, the power contacts 208 and 209 pass through aligned openings in the wafer housing 206 and the header module 902. The aligned openings are positioned relative to other connection components (e.g., the connection components of the wafer housing 206 that mate with the wafer assemblies 1304), such that the power contacts 208 and 209 are located outside of the housing components 1306 and 1312 when the power contacts 208 and 209 and the plurality of wafer assemblies 1304 are engaged with the wafer housing 206. For example, the power contacts 208 and 209 may be external to the housings of the wafer assemblies 1304.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A wafer assembly, comprising:

a metal center ground plane;

a plurality of plastic ribs overmolded on the metal center ground plane in a configuration that forms a plurality of electrical contact channels on the metal center ground plane; and an array of electrical contacts positioned substantially within the plurality of electrical contact channels;

wherein the metal center ground plane is electrically connected with one or more conductive surfaces of the plurality of plastic ribs.

2. The wafer assembly of claim 1, wherein the array of electrical contacts is configured to connect with a first substrate and a second substrate, and wherein the array of electrical contacts provides a plurality of signal transmission paths between the first substrate and the second substrate.

3. The wafer assembly of claim 1, wherein the array of electrical contacts comprises a conductive leadframe at least partially surrounded by an overmolded insulation layer.

4. The wafer assembly of claim 3, wherein the plurality of electrical contact channels comprise electrically conductive surfaces, and wherein the overmolded insulation layer of the array of electrical contacts electrically isolates the array of electrical contacts from the electrically conductive surfaces of the plurality of electrical contact channels.

5. The wafer assembly of claim 1, wherein the plurality of plastic ribs comprise a first plastic rib portion and a second plastic rib portion, and wherein the first and second plastic rib portions are overmolded onto the metal center ground plane such that a portion of the metal center ground plane is exposed between the first plastic rib portion and the second plastic rib portion.

6. The wafer assembly of claim 1, wherein the plurality of electrical contact channels comprise a channel defined by a plurality of first plastic rib portions that form a first wall on one side of the channel and a plurality of second plastic ribs portions that form a second wall on an opposing side of the channel.

7. The wafer assembly of claim 6, wherein a first rib portion of the plurality of first plastic rib portions is substantially parallel with a corresponding first rib portion of the plurality of second plastic rib portions, wherein a second rib portion of the plurality of first plastic rib portions is substantially parallel with a corresponding second rib portion of the plurality of second plastic rib portions; and wherein the first rib portion of the plurality of first plastic rib portions is not substantially parallel with the second rib portion of the plurality of second plastic rib portions.

8. The wafer assembly of claim 1, wherein the metal center ground plane comprises a plurality of holes that pass from a first side face of the metal center ground plane to a second side face of the metal center ground plane, and that allow passage of plastic molding material when the plurality of plastic ribs are overmolded onto the metal center ground plane.

9. The wafer assembly of claim 1, wherein the plastic ribs are plated with a conductive material.

10. The wafer assembly of claim 1, wherein the plastic ribs are formed of a conductive plastic.

11. A wafer assembly, comprising:

a metal center ground plane;

a plurality of first plastic ribs overmolded on a first side face of the metal center ground plane in a configuration that forms a plurality of first electrical contact channels on the first side face of the metal center ground plane;

a first array of electrical contacts positioned substantially within the plurality of first electrical contact channels;

a plurality of second overmolded ribs on a second side face of the metal center ground plane in a configuration that forms a plurality of second electrical contact channels on the second side face of the metal center ground plane; and a second array of electrical contacts positioned substantially within the plurality of second electrical contact channels;

wherein the metal center ground plane is electrically connected with one or more conductive surfaces of the plurality of first plastic ribs and one or more conductive surfaces of the plurality of second plastic ribs.

12. The wafer assembly of claim 11, wherein the plurality of first plastic ribs are aligned relative to the plurality of second plastic ribs such that each electrical contact of the first array of electrical contacts is positioned adjacent to an electrical contact of the second array of electrical contacts to form a plurality of differential pairs of electrical contacts.

13. The wafer assembly of claim 11, wherein the plurality of first plastic ribs comprise a first plastic rib portion and a second plastic rib portion, and wherein the first and second plastic rib portions are overmolded onto the metal center ground plane such that a portion of the metal center ground plane is exposed between the first plastic rib portion and the second plastic rib portion.

14. The wafer assembly of claim 11, wherein the plurality of first electrical contact channels comprise a channel defined by a first rib portion and a second rib portion that form a first wall on one side of the channel, and a third rib portion and a fourth rib portion that form a second wall on an opposing side of the channel;

wherein the first rib portion is substantially parallel with the third rib portion, wherein the second rib portion is substantially parallel with the fourth rib portion; and wherein the first rib portion is not substantially parallel with the fourth rib portion.

15. An electrical connector system, comprising:

a plurality of wafer assemblies, each of the wafer assemblies comprising:

a metal center ground plane;

a plurality of plastic ribs overmolded on the metal center ground plane in a configuration that forms a plurality of first electrical contact channels on a first side face of the metal center ground plane and a plurality of second electrical contact channels on a second side face of the metal center ground plane;

a first array of electrical contacts positioned substantially within the plurality of first electrical contact channels; and a second array of electrical contacts positioned substantially within the plurality of second electrical contact channels, wherein the first and second arrays of electrical contacts are configured to connect with a first substrate and a second substrate and provide a plurality of signal transmission paths between the first substrate and the second substrate;

a wafer housing that positions the plurality of wafer assemblies adjacent to one another in the electrical connector system, wherein the wafer housing comprises a first guidance component;

a header module that mates with the wafer housing, wherein the header module comprises a second guidance component dimensioned to engage with the first guidance component to align the header module with the wafer housing when the wafer housing mates with the header module; and a power contact that passes through aligned openings in the wafer housing and the header module to provide a power transmission path between the first substrate and the second substrate;

wherein the metal center ground plane is electrically connected with one or more conductive surfaces of the plurality of plastic ribs.

* * * * *